US005813097A

United States Patent [19]

Woellert et al.

[11] Patent Number: 5,813,097

[45] Date of Patent: Sep. 29, 1998

[54] DUAL TONGUE BUCKLE WITH INDEPENDENT LATCHING

[75] Inventors: Thomas P. Woellert, Indianapolis; Michael A. Wiseman, Avon, both of Ind.

[73] Assignee: Indiana Mills and Manufacturing, Inc., Westfield, Ind.

[21] Appl. No.: 771,953

[22] Filed: Dec. 23, 1996

[51] Int. Cl.[6] ..... A44B 11/00

[52] U.S. Cl. ..... 24/631; 24/632; 24/642; 24/573.5

[58] Field of Search ..... 24/631, 632, 633, 24/642, 639, 573.5; 297/468

[56] References Cited

U.S. PATENT DOCUMENTS

| | | | |
|---|---|---|---|
| 4,617,705 | 10/1986 | Anthony et al. . | |
| 4,692,970 | 9/1987 | Anthony et al. . | |
| 5,023,981 | 6/1991 | Anthony et al. . | |
| 5,038,446 | 8/1991 | Anthony et al. . | |
| 5,086,548 | 2/1992 | Tanaka et al. | 24/573.5 |
| 5,142,748 | 9/1992 | Anthony et al. | 24/632 |
| 5,182,837 | 2/1993 | Anthony et al. | 24/632 |
| 5,220,713 | 6/1993 | Lane, Jr. et al. . | |
| 5,283,933 | 2/1994 | Wiseman et al. . | |

*Primary Examiner*—Victor N. Sakran

*Attorney, Agent, or Firm*—Woodard, Emhardt, Naughton, Moriarty & McNett

[57] ABSTRACT

A dual tongue buckle includes a single latch member and a single ejection member housed within a buckle main body, and a pair of tongue members that are slidable relative to each other. When the first tongue is advanced sufficiently into the buckle main body over the latch member, the tongue forces the ejection member to rotate away from that side of the latch member allowing the latch member to lock to the first tongue, while the opposite end of the ejection member maintains the opposite end of the latch member in a pre-latched position. When the second tongue is advanced sufficiently into the buckle main body, it forces the opposite end of the ejection member away from the latching member to thereby lock the second tongue thereto. A releasing member depresses the latch member so that the ejection member at least partially ejects any of the tongue members latched therein from the buckle main body.

20 Claims, 6 Drawing Sheets

DUAL TONGUE BUCKLE WITH INDEPENDENT LATCHING

FIELD OF THE INVENTION

The present invention relates generally to safety restraining devices, and more specifically to safety belt systems having multiple tongues releasably latchable to a buckle apparatus.

BACKGROUND OF THE INVENTION

Many seat belt buckles have been devised to maximize holding capability as well as to improve the cost and ease of manufacture thereof. Examples of such seat belt buckles are disclosed in U.S. Pat. Nos. 4,617,705 and 4,692,970, both issued to James R. Anthony, et al., and assigned to the Assignee of the present invention. In many cases, the seat belt tongue is split into two separate tongues for attachment respectively to a seat belt and a shoulder harness. In order to increase the fit and engagement between the buckle and the tongue or pair of tongues inserted into the buckle, and to insure the tongues are not mounted upside down in the buckle, it is customary to provide a pair of flanges extending outwardly therefrom which facilitate insertion of the tongues into the buckle.

Heretofore, it was known to provide a belt buckle engageable with a pair of tongues wherein the buckle would not lockingly engage when only a single tongue was inserted into the buckle, but rather would require simultaneous insertion of the two tongues in order to trigger the latch mechanism. To facilitate simultaneous insertion of the two tongues, interlocking tongues have thus been developed, and examples of such belt buckles having interlocking dual tongues are disclosed in U.S. Pat. Nos. 5,023,981 and 5,038,446, both issued to James R. Anthony et al., and in U.S. Pat. No. 5,283,933, issued to Michael A. Wiseman et al., all of which are and assigned to the Assignee of the present invention. Both of these patents disclose belt buckle arrangements that lockingly engage the dual tongues only when both tongues are fully inserted into the buckle. However, simultaneously inserting the dual tongues into the buckle in order to trigger the latching mechanism has drawbacks associated therewith. Dual interlocking tongues essentially become a single tongue when interlocked together before being inserted into the buckle. Difficulty therefore occurs in connecting the interlocking features when both hands are needed for other tasks such as maintaining an infant properly positioned in a child restraint seat while the restraints are being secured.

Other known dual tongue systems have mating surfaces associated with the tongues to aid the user in simultaneously inserting both tongues into the buckle. While this type of dual tongue structure can substantially eliminate some of the problems encountered in interlocking dual tongues, these designs still have the drawback that the dual tongues can slide relative to one another, and therefore can result in some difficulty inserting both tongues simultaneously into the buckle in order to trigger the latching mechanism.

Another system known in the art for securing at least two webs to a single buckle is to provide one of the webs with an ordinary tongue and the other with a plastic or metallic loop in place of a tongue. The loop is sized large enough to receive the tongue bar of the tongue, but is too small to slip over the handle portion of the tongue. The webs are secured to the buckle by advancing the tongue bar of the tongue through the loop, and then advancing the tongue bar into the buckle to trigger the latching mechanism. In this way, the web having the loop attachment is trapped between the buckle and the handle portion of the tongue. As with the prior art discussed hereinabove, this type of tongue and loop system suffers from the disadvantage of difficulty in assembly before the webs are secured to the belt buckle.

Another known dual tongue buckle arrangement is disclosed in U.S. Pat. No. 5,220,713 to Lane Jr. et al. and includes a pair of non-interlocking and non-interactive tongue members latchable to a buckle main body. Each tongue member includes a separate ejection mechanism operable to independently eject the tongue member, at least partially, from the buckle main body as the tongue and buckle main body are unlatched. However, the dual tongue members are not independently latchable to the buckle, and must rather be simultaneously latched to the buckle. Thus, the Lane Jr. et al. suffers from the same drawbacks as other known prior art buckle systems as described hereinabove. Further, the Lane Jr. et al. buckle system is somewhat cumbersome to operate in that each of the tongue members must be separately and independently ejected from the buckle main body as they are unlatched therefrom.

What is therefore needed is a non-interlocking and non-interactive dual tongue system operable to independently latch each of the pair of tongues, or in other words, latch a single tongue at a time of a dual tongue buckle system. Such a buckle-tongue arrangement should be further operable to simultaneously unlatch and at least partially eject from the buckle main body any and all tongue members latched thereto. Such a system should not suffer from any of the drawbacks discussed hereinabove, nor introduce new drawbacks to a dual tongue buckle system.

SUMMARY OF THE INVENTION

The foregoing shortcomings of prior art dual tongue buckle systems are addressed by the present invention. In accordance with the invention, a belt buckle-tongue combination comprises a housing, a plate mounted to the housing, wherein the plate and housing define a cavity therebetween and a plurality of tongue members receivable within the cavity. Also included are latch means for engaging with any of the tongue members independently of insertion of any of the remaining tongue members into the cavity, and operator means for simultaneously releasing each of the tongue members from the latch means. An ejection means separate from the plurality of tongue members is provided for at least partially ejecting from the cavity each of the tongue members released from the latch means. A cover is provided over the housing with the plate positioned therebetween.

In accordance one aspect of the invention, the latch means includes a single latch member held captive within the cavity by the plate affixed to the housing wherein the latch member is moveably toward and away from the plate. The latch member is operable to latch any of the plurality of tongue members thereto independently of insertion of remaining ones of tongue members, or to simultaneously latch all of the plurality of tongue members thereto.

In accordance with another aspect of the present invention, the ejection means includes a single ejection member positioned within the cavity and held captive therein by the plate affixed to the housing. The ejection member is responsive to movement of the latch means away from the plate to at least partially eject from the cavity any of the tongue members unlatched from the latch means.

One object of the present invention is to provide an improved dual tongue buckle arrangement that features independent latching of each of the buckle tongue members.

Another object of the present invention is to provide such a buckle arrangement that is operable to unlatch and at least partially eject therefrom any and all tongue members latched thereto.

These and other objects of the present invention will become more apparent from the following description of the preferred embodiment.

DESCRIPTION OF THE PREFERRED EMBODIMENT

Figure 1:
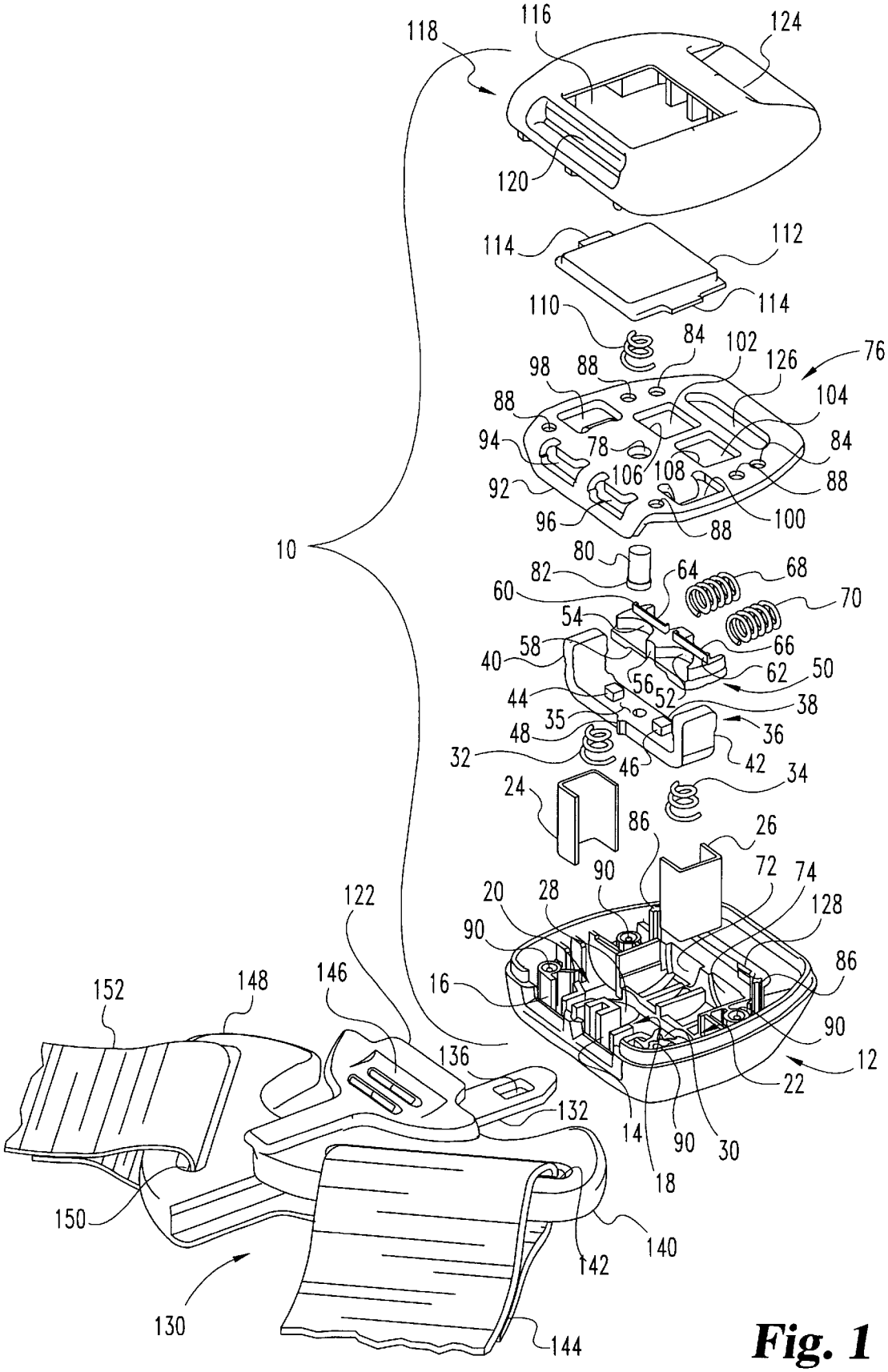
FIG. 1 is an exploded, perspective view showing a preferred embodiment of a dual tongue buckle with independent latching, in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 5:
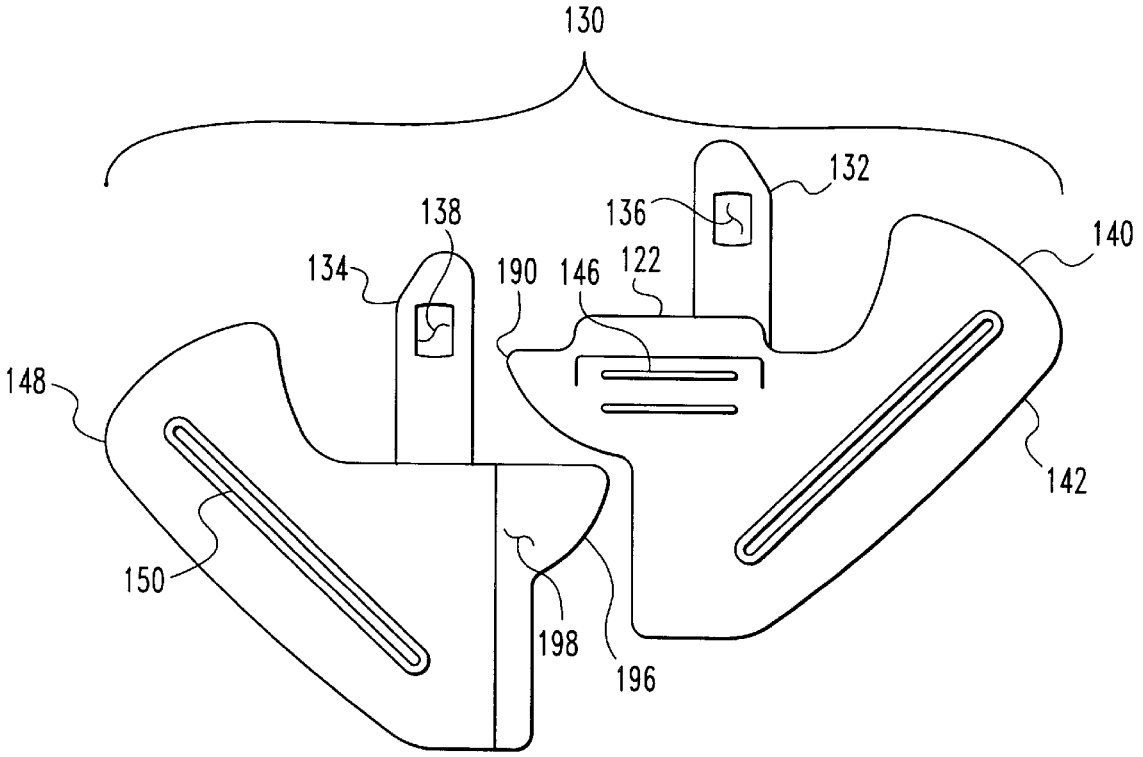
FIG. 5 is a top view of the dual tongue arrangement of FIG. 1 showing the tongues slightly separated.
Figure 6:
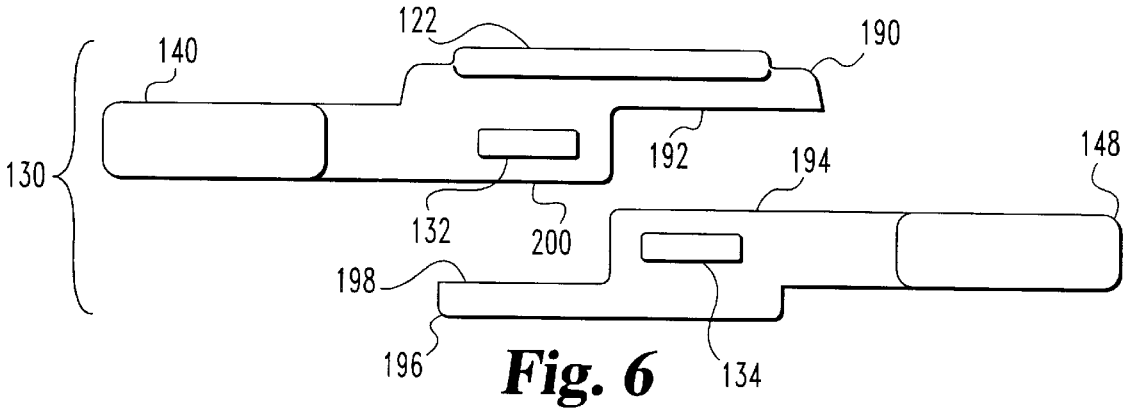
FIG. 6 is an end view of the dual tongue arrangement of FIG. 5 again showing the tongues slightly separated.

Referring now to FIG. 1, one embodiment of a buckle tongue combination, in accordance with the present invention, is shown comprising a buckle 10 shown in exploded view and a buckle tongue 130 having a pair of non-interlocking and non-interactive tongues 132 and 134 (tongue 134 not shown in FIG. 1, but clearly shown in FIGS. 5 and 6). Buckle 10 includes a main body, or housing, 12 defining a pair of mouth portions 14 and 16 for respectively receiving the leading edges of tongues 132 and 134 which extend into a cavity 18 formed in housing 12.

Housing 12 defines a pair of opposing cavities 20 and 22 at opposite ends of cavity 18 which receive a pair of complimentary sized channels 24 and 26 respectively therein. Between channels 24 and 26, housing 12 defines a pair of spring recesses 28 and 30 in which helical springs 32 and 34 respectively rest. Preferably, springs 32 and 34 are frustoconical in shape, although the present invention contemplates that springs 32 and 34 may be configured with alternate shapes such as, for example, cylindrical. Alternatively, springs 32 and 34 may be replaced by a single flat/arc spring. In any case, a latch, or pawl, member 36 is positioned within cavity 18 such that channels 24 and 26 slidably receive the mutually opposed and upturned arms 40 and 42 of latch 36. Latch 36 preferably defines a pair of raised portions 44 and 46 extending upwardly therefrom for engagement with tongues 132 and 134 as will be described hereinafter, although the present invention contemplates providing any number of raised portions extending from latch 36 to engage with a corresponding number of tongues. Latch 36 further defines a projection 48 extending therefrom toward mouth portions 14 and 16 of housing 12. In operation, springs 32 and 34 act to bias latch 36 upwardly in a direction away from cavity 18.

Buckle 10 further includes an ejection member 50 which defines forwardly opening concave surfaces 52 and 54 therein for respectively engaging the rounded distal ends of tongues 132 and 134 as will be more fully described hereinafter. Between concave surfaces 52 and 54, ejection member 50 defines a concave surface 56 which is preferably formed with a predefined radius. In assembled form, concave surface 56 is positioned adjacent to a lower flange 82 of a tongue release member, or post, 80 which is preferably generally cylindrical in shape. Concave surface 56 of ejection member 50 is therefore preferably sized with a radius slightly larger than that of lower flange 82 of post 80 so that surface 56 is positioned radially about a portion of post 80 as most clearly illustrated in FIG. 3. Extending upwardly from ejection member 50 are a pair of flange portions 60 and 62 which are positioned adjacent to concave surfaces 54 and 52 respectively.

Figure 2:
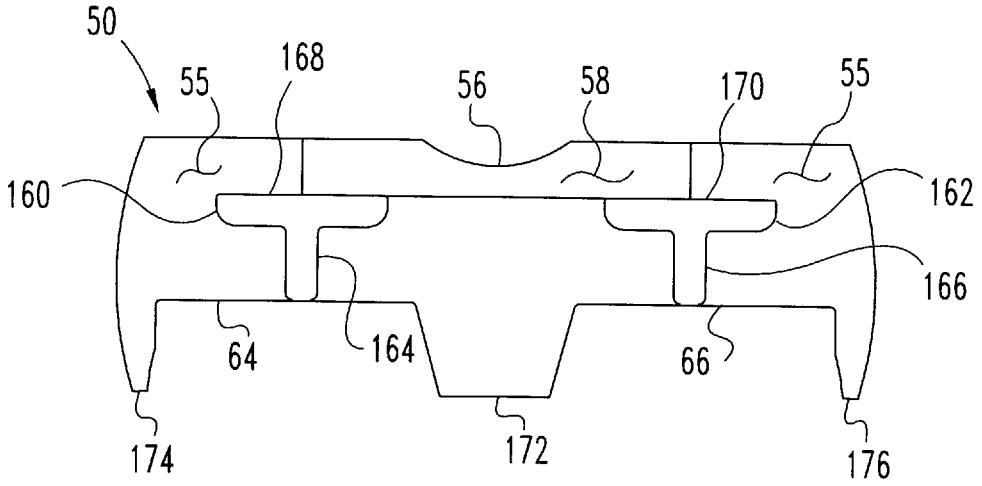
FIG. 2 is a bottom plan view of the ejection member of FIG. 1.

Referring now to FIG. 2, a bottom plan view of ejection member 50, in accordance with a preferred embodiment thereof, is shown. Ejection member 50 defines a bottom surface 55 positioned partially beneath concave surfaces 52 and 54, which further defines a recessed portion 58 therein extending approximately between the midpoints of surfaces 52 and 54 and beneath concave surface 56 along a front portion of ejection member 50. Ejection member 50 further defines a first back wall surface 64 between bottom surface 55 and the top of flange portion 60, and a second back wall surface 66 between the bottom surface 55 and the top of flange portion 66 (see FIG. 1). Back wall surfaces 64 and 66 are separated by a protrusion 172 extending perpendicularly away from surfaces 64 and 66 and positioned therebetween. An opposite side of back wall surface 64 is defined by a projection 174 extending from one end of ejection member 50 in a direction perpendicularly away from back wall surface 64, and an opposite end of back wall surface 66 is defined by a protrusion 176 extending from an opposite end of ejection member 50 in a direction perpendicularly away from back wall surface 66.

Bottom surface 55 includes a pair of T-shaped projections 160 and 162 extending perpendicularly away therefrom. Projection 160 defines a front surface 168 substantially parallel with recess 58 and facing generally in the same direction as concave surface 56. T-shaped projection 160 further includes a leg portion 164 extending rearwardly therefrom. Projection 162 similarly defines a front surface 170 identical to front surface 168, and a leg portion 166 extending rearwardly therefrom. Preferably, front surfaces 168 and 170 are centered beneath concave surfaces 54 and 52 respectively.

Referring again to FIG. 1, ejection member 50 is positioned against latch 36 such that bottom surface 55 adjacent front surfaces 168 and 170 rests against top surface 35 of latch 36, and front surfaces 168 and 170 of projections 160 and 162 respectively rests against a back surface 38 of latch 36. A first spring 68 is positioned between back wall surface 64 of ejection member 50 and a corresponding spring recess 72 defined within housing 12. Similarly, a second spring 70 is positioned between back wall surface 66 of ejection member 50 and a spring recess 74 defined within housing 12. Springs 68 and 70 are preferably cylindrical in shape, although the present invention contemplates providing springs 68 and 70 with other known shapes such as, for example, frustoconical. In any case, springs 68 and 70 are operable to urge ejection member 50 against latch 36 such that front surfaces 168 and 170 of projections 160 and 162 are biased against back wall or surface 38 of latch 36.

Buckle 10 further includes a plate 76 which is attached to housing 12 via a number of fasteners (not shown) extending through bores 88 of plate 76 into engagement within corresponding bores 90 of housing 12. In order to provide proper alignment between plate 76 and housing 12, housing 12 further includes a pair of guide members 86 extending upwardly therefrom which are received within corresponding bores 84 of plate 76 as plate 76 is mounted to housing 12. Plate 76 further includes a forward downwardly sloped portion 92 defining a pair of tongue slots 94 and 96 therein. Tongues 132 and 134 of buckle tongue 130 extend through slots 96 and 94 respectively into cavity 18 for engagement with latch 36 as will be described more fully hereinafter. Plate 76 further defines a pair of slots 98 and 100 for receiving a portion of channels 24 and 26 respectively, as well as a portion of arms 40 and 42 of latch 36 respectively therethrough. Plate 76 also defines a pair of slots 102 and 104 therein having front slot surfaces 106 and 108 respectively. Finally, plate 76 defines a bore 78 through which post 80 upwardly extends. Bore 78 is sized to permit post 80 to be slidingly received therein, yet disallow passage of flange 82 therethrough.

When plate 76 is secured to housing 12 via a number of fasteners (not shown) as described above, plate 76 and housing 12 hold latch 36 captive within the cavity 18 defined therebetween. Springs 32 and 34 urge latch 36 upwardly toward plate 76, and raised portions 44 and 46 are prevented from contacting the underside of plate 76 only by ejection member 50 positioned against latch 36 as described hereinabove, and held within housing 12 by plate 76. With no belt tongue latchingly engaged with latch 36, springs 68 and 70 force flange portions 64 and 66 of ejection member 50 against slot surfaces 106 and 108 of plate 76 respectively to thereby maintain ejection member 50 positioned against latch 36 as described hereinabove. As with latch 36, ejection member 50 is also held captive within cavity 18 by housing 12 and plate 76. In such a position, latch 36, plate 76 and ejection member 50 define first and second tongue channels therebetween having tongue channel entrances 94 and 96 respectively. The first tongue channel is defined by the portion of latch 36 having raised portion 44 extending therefrom, concave surface 54 of ejection member 50 and the portion of plate 76 extending between tongue channel entrance 94 and slot 102. Similarly, the second tongue channel is defined by the portion of latch 36 having raised portion 46 extending therefrom, concave surface 52 of ejection member 50 and the portion of plate 76 extending between tongue channel entrance 96 and slot 104. As will be described more fully hereinafter, each of tongues 132 and 134 may be separately inserted into a corresponding one of the first and second tongue channels to force a corresponding portion of ejection member 50 out of the tongue channel such that latch 36 engages with the tongue.

Buckle 10 further includes a top cover 118 which extends over plate 76 into engagement with housing 12. Preferably, housing 12 and top cover 118 include complimentarily configured flange portions thereabout to facilitate attachment therebetween as is known in the art. Top cover 118 defines an aperture 116 therein through which a push button 112 upwardly extends. Push button 112 preferably includes a pair of tabs 114 extending laterally therefrom which act to maintain push button 112 within aperture 116. A helical spring 110, preferably frustoconical in shape, is disposed over a portion of post 80 extending upwardly through bore 78 of plate 76 to bias push button 112 upwardly through aperture 116 against an inner surface of top cover 118 (not shown). Push button 112 is thus located between cover 118 and plate 76 and partially projectable through aperture 116 of cover 118 to allow an operator to depress the button 112, thereby forcing flange portion 82 of post 80 into contact with upper surface 35 of latch 36 such that latch 36 moves downwardly away from plate 76. Helical spring 110 is operable to force button 112 upwardly but also yieldable to allow button 112 to be depressed and thereby force post 80 downwardly. As is known in the art, spring 112 thus increases the positive force required to depress button 112.

Top cover 118 further defines a mouth portion 120 which cooperates with flange 122 of flange portion 140 to form a "keyed" relationship therebetween. This keying arrangement makes it impossible to insert the tongues 132 and 134 upside down into tongue channel entrances 96 and 94 respectively, thereby avoiding a twisted web (144 and 152) condition. Finally, top cover 118 defines a slot 124 therethrough, plate 76 defines a corresponding slot 126 therethrough, and housing 12 defines a corresponding slot 128 therethrough, which, when buckle 10 is fully assembled, are in alignment to provide a continuous slot through buckle 10 through which a web, such as a belt, may be attached.

Housing 12, ejection member 50, push button 112, post 80 and top cover 118 are preferably made from a lightweight material such as plastic, while channels 24 and 26, latch 36, plate 76 and all springs are preferably formed of a stronger material such as steel, although the present invention contemplates forming any of the various components of buckle 10 from alternate materials as is known in the art.

Referring now to FIGS. 1, 5 and 6, buckle tongue member 130 includes a pair of non-interlocking and non-interactive buckle tongues 132 and 134, each defining apertures 136 and 138 respectively through which raised portions 44 and 46 respectively of latch 36 may project. Tongue 132 is connected to a flange portion 140 which defines a slot 142 therethrough, and tongue 134 is attached to a similar flange portion 148 which defines a slot 150 therethrough. Slots 142 and 150 may receive therethrough, as shown in FIG. 1, webs 144 and 152 respectively, wherein the two webs 144 and 152 may represent a seat belt and shoulder harness web.

Referring specifically to FIGS. 5 and 6, buckle tongue member 130 is preferably configured such that tongues 132 and 134 are slidably moveable with respect to each other in direction parallel with a longitudinal axis of either tongue 132 or 134, yet further configured so that both of tongues 132 and 134 may be simultaneously grasped when both are engaged with buckle 10. In accordance with an important aspect of the present invention, such a configuration permits tongues 132 and 134 to be either separately (individually) latchable within buckle 10 without impeding the latchability of the remaining tongue, or simultaneously latchable within buckle 10, and further permits both tongues to be simultaneously grasped when both are latched to buckle 10. One embodiment of buckle tongue member 130 for achieving the foregoing goals is most clearly shown in FIGS. 5 and 6 wherein flange 140 includes a projection 190 having a bottom surface 192 which is adapted to non-interlockably and non-interactively contact upper surface 194 of flange 148. Similarly, flange 148 defines an oppositely extending projection 196 defining a top surface 198 adapted to non-interlockably and non-interactively contact a bottom surface 200 of flange 140. Flanges 140 and 148 are thus configured for contacting engagement with flange 140 positioned over flange 148. To facilitate the simultaneous grasping of flanges 140 and 148, flange 140 is provided with a ribbed portion 146 on a top surface thereof which is located between tongues 132 and 134 when flanges 140 and 148 are positioned in contacting relationship. In such contacting relationship, tongues 132 and 134 may be simultaneously handled by simultaneously grasping projection 190 of flange 140 and projection 196 of flange 148, preferably in the vicinity of ribbed portion 146 and a corresponding undersurface of flange 148. Tongues 132 and 134 are thus configured for either individual or simultaneous handling thereof.

As stated hereinabove, an important aspect of the present invention is to permit either separate (individual) latching of tongues 132 and 134 to buckle 10, or simultaneous latching a tongues 132 and 134 to buckle 10. Another important aspect of the present invention is to provide for the ability to eject at one time any number of tongues that may be latchingly engaged to buckle 10. Thus, buckle 10 is preferably configured to eject, in response to appropriate pressure applied to push button 112 (FIG. 1) either one of tongues 132 or 134 singularly engaged with latch 36, or simultaneously eject both tongues 132 and 134 when both are engaged with latch 36. With reference to FIGS. 3–4 and 7–10, the operation of buckle 10 and buckle tongue member 130 in achieving the foregoing goals will be described in detail.

Figure 3:
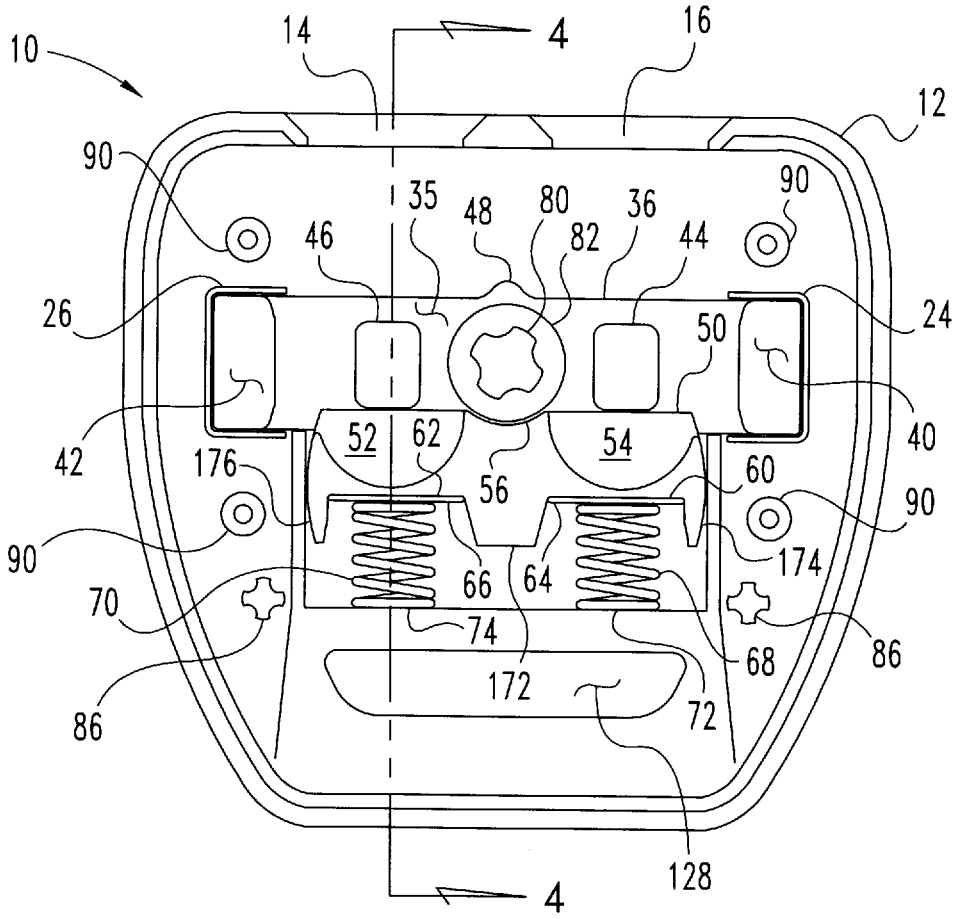
FIG. 3 is a top plan view of the buckle arrangement of FIG. 1 with the reinforcement plate and portions thereabove removed to illustrate the position of the latch and ejection members.
Figure 4:
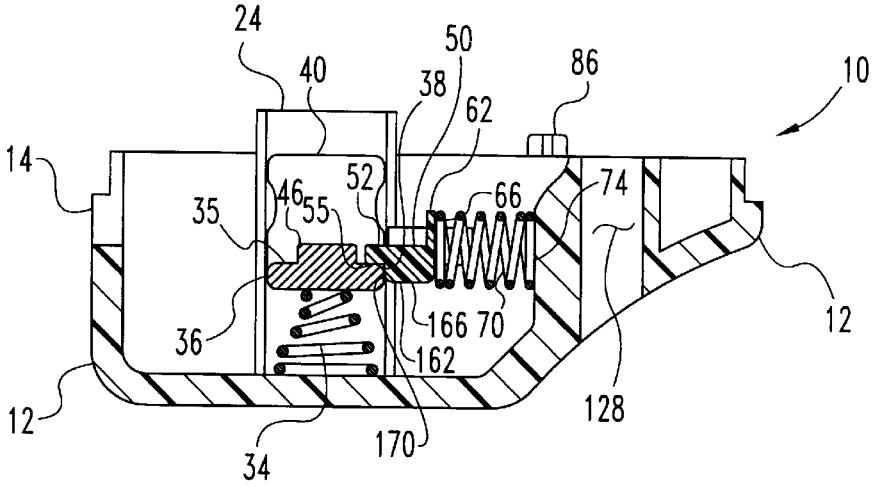
FIG. 4 is a cross-sectional view of the buckle arrangement of FIG. 3 viewed along section lines 4—4.

Referring specifically to FIGS. 3 and 4, buckle 10 is shown without plate 76, push button 112 and top cover 118 attached thereto, and without either of tongues 132 or 134 inserted therein to clearly illustrate the interaction between latch 36 and ejection member 50. As previously described, ejection member 50 is positioned to engage a portion of the top surface 35 of latch 36. As most clearly shown in FIG. 3, ejection member 50 is positioned over latch 36 such that concave surface 54 is positioned in line with mouth portion 16 of housing 12 with raised portion 44 of latch 36 positioned therebetween adjacent concave surface 54. Likewise, concave surface 52 is positioned in line with mouth portion 14 of housing 12 with raised portion 46 of latch 36 positioned therebetween adjacent concave surface 52. Spring 68 is positioned between spring recess 72 of housing 12 and back wall portion 60 of ejection member 50, and spring 70 is positioned between spring recess 74 of housing 12 and back wall portion 66 of ejection member 50. The springs 68 and 70 are, in the position shown in FIG. 3, under compression, and are therefore operable to urge ejection member 50 against latch 36 as shown. It should be further pointed out that concave surface 56 of ejection member 50 is positioned radially about the flange 82 of post 80.

Referring now specifically to FIG. 4, which is a cross-sectional view along section lines 4—4 of FIG. 3, front surface 170 of T-shaped projection 162 (FIG. 2) is shown biased against the back wall 38 of latch 36. Similarly, the bottom surface 55 of ejection member 50 adjacent front surface 170 is positioned against the top surface 35 of latch 36. Although not shown in FIGS. 3 and 4, the underside of plate 76 exerts a downward force on ejection member 50 as previously described, to thereby force ejection member 50, and consequently latch 36, against the biasing force of springs 32 and 34. Thus, as shown in FIG. 4, spring 34 is under compression to force surface 35 of latch 36 against surface 55 of ejection member 50. In the configuration shown in FIGS. 3 and 4, raised portions 44 and 46 of latch 36 are approximately coextensive with concave surfaces 52 and 54 respectively so that tongues 132 and 134 may be received within mouth portions 14 and 16 respectively such that the distal ends of tongues 132 and 134 contact concave surfaces 52 and 54 respectively without latching either of tongues 132 or 134 to latch 36.

Figure 7:
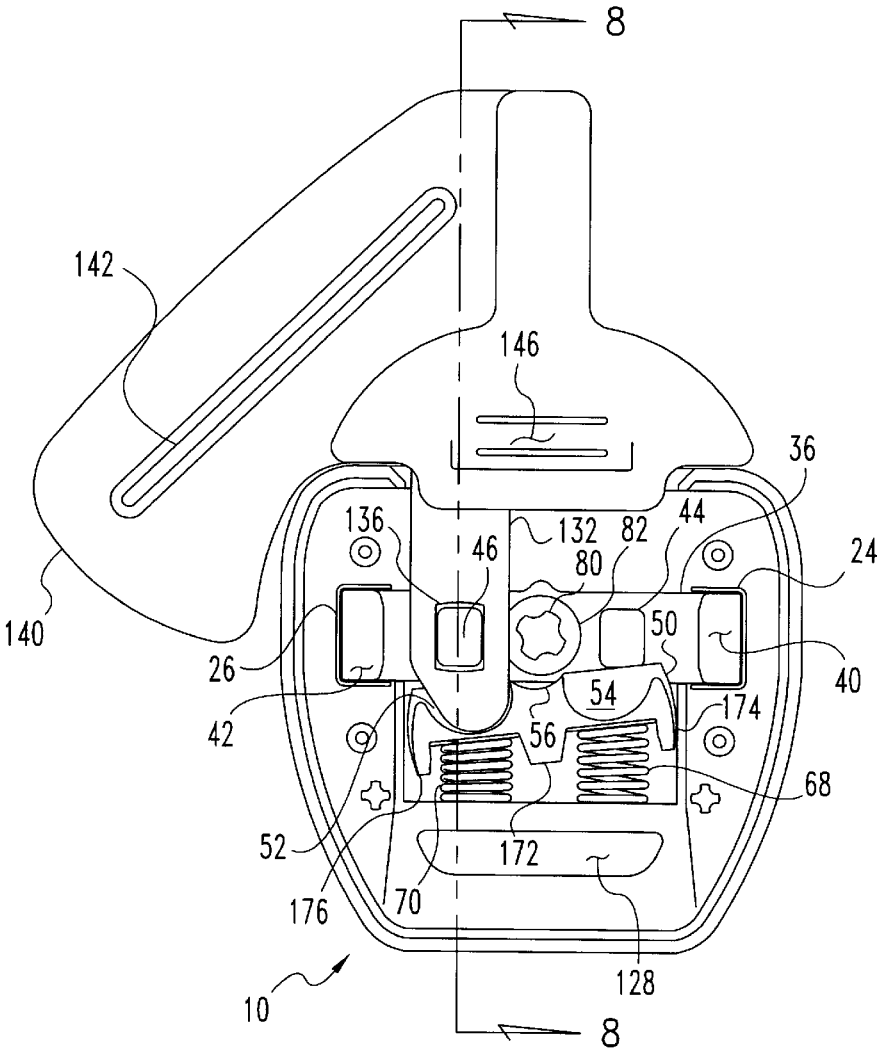
FIG. 7 is the same view as FIG. 3 only showing a single tongue inserted into the buckle.
Figure 8:
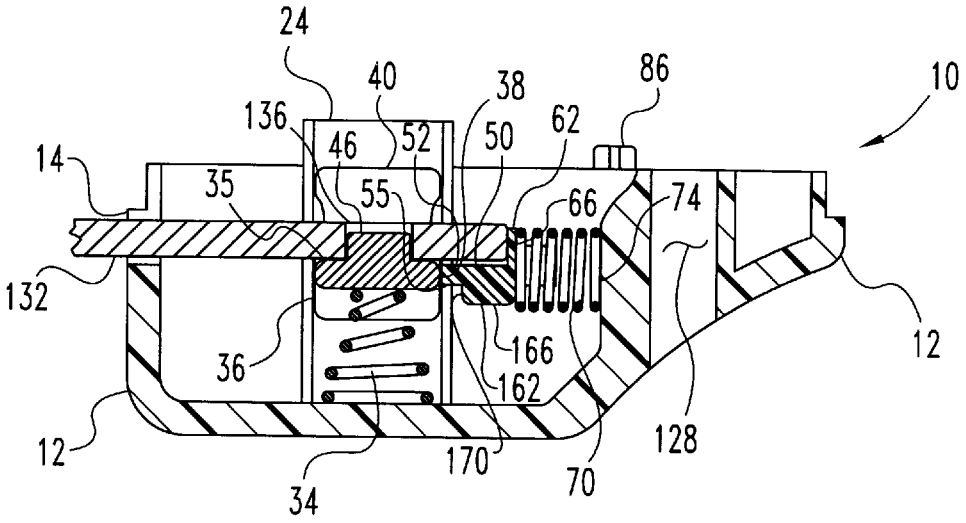
FIG. 8 is a cross-sectional view of the buckle of FIG. 7 viewed along section lines 8—8.
Figure 9:
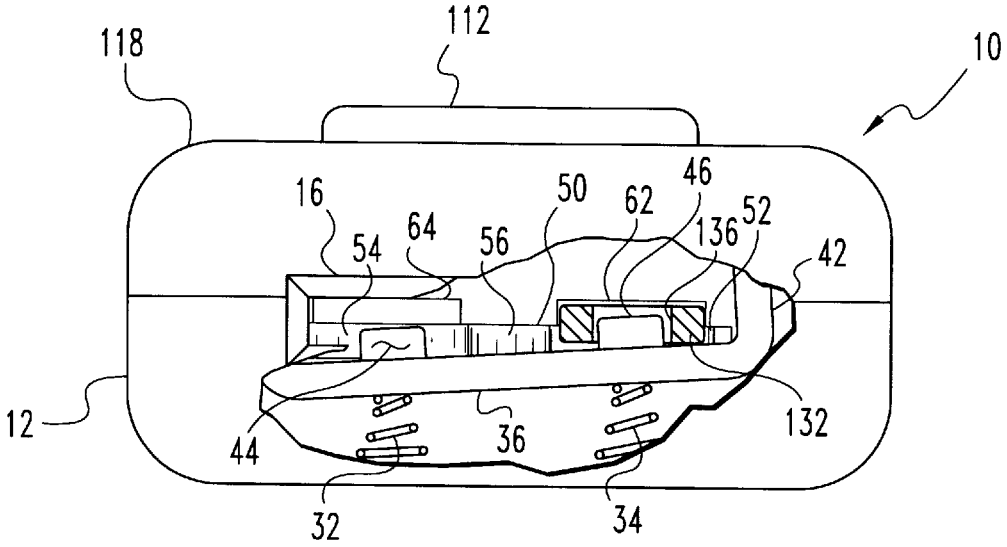
FIG. 9 is an end view of the buckle arrangement of FIG. 1 in partial cutaway showing a single tongue inserted therein.

Referring now to FIGS. 7–9, buckle 10 is shown having a single tongue 132 latchingly engaged therewith. Referring specifically to FIG. 7, it can be seen that as the distal portion of tongue 132 is advanced into contact with concave surface 52 sufficiently to overcome the biasing force of spring 70, the portion of ejection member 50 defining concave surface 52 rotates, or pivots, away from latch 36 while the portion of ejection member 50 defining concave surface 54 remains in contact with latch 36 as described with respect to FIGS. 3 and 4. Under such conditions, the portion of latch 36 defining raised portion 46 is urged upwardly under the force of spring 34 such that raised portion 46 is received within aperture 136 of tongue 132 to thereby latchingly engage tongue 132 to latch 36. Referring to FIG. 8, which is a cross-sectional view along section lines 8—8 of FIG. 7, it can be seen that as the distal end of tongue 132 is forced against concave surface 52 of ejection member 50, the biasing force of spring 70 is eventually overcome so that the front surface 170 of T-shaped projection 162 (FIG. 2) is forced away from back surface 38 of latch 36. As soon as the bottom surface 55 adjacent front surface 170 of T-shaped projection 162 is pushed away from top surface 35 of latch 36, latch 36 is forced upwardly under the biasing force of spring 34 into the position illustrated in FIG. 9. Although not shown specifically in the drawings, it is to be understood that tongue 134 may be alternately separately latched to buckle 10 in a manner similar to that described with respect to FIGS. 7–9 but involving raised portion 44 of latch 36 and concave surface 54 of ejection member 50.

Referring back to FIG. 2, the recessed portion 58 within bottom surface 55 of ejection member 50 is preferably configured to extend approximately between the midpoints of front surfaces 168 and 170 of T-shaped projections 160 and 162 respectively. Such a configuration of recessed portion 58 facilitates the rotation of a portion of ejection member 50 away from a corresponding portion of latch 36 while maintaining another portion of ejection member in contact with a corresponding portion of latch 36. For example, as illustrated in FIGS. 7–9, the recessed portion 58 facilitates the rotation of concave surface 52 portion of ejection member 50 away from the portion of latch 36 having raised portion 46 extending therefrom while maintaining the bottom surface 55 beneath concave surface 54 in contact with the top surface 35 of latch 36 adjacent raised portion 44 thereof. While recess 58 may be defined within the bottom surface 55 of ejection member 50 having various lengths, those skilled in the art will recognize that a recess 58 of at least some length is required to break the bottom surface 55 into separate latch retaining surfaces in order to actuate latch 36 as described hereinabove and illustrated in FIGS. 7–9.

Figure 10:
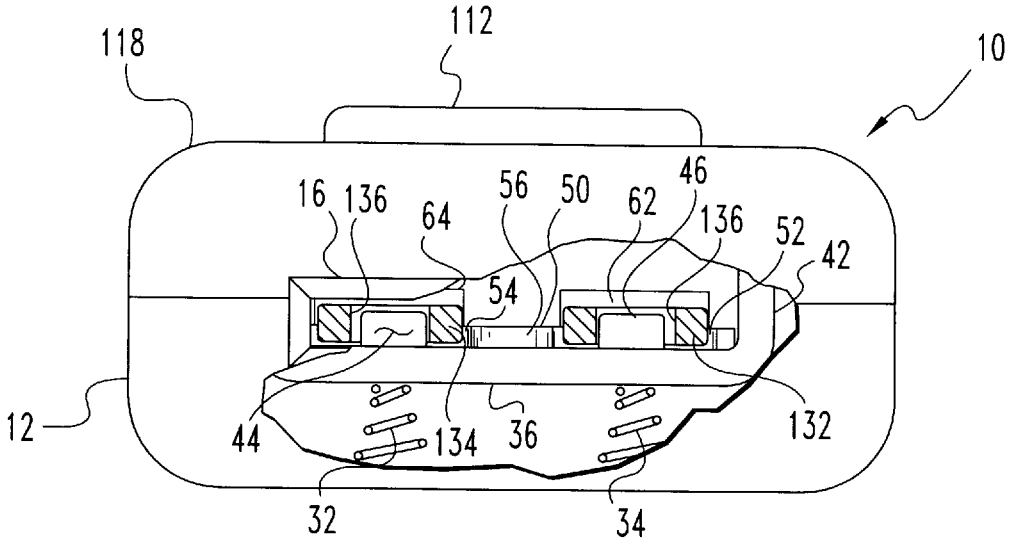
FIG. 10 is the same view as FIG. 9 only showing both tongues inserted into the buckle arrangement.

Referring now to FIG. 10, buckle 10 is illustrated as having both tongues 132 and 134 simultaneously latched thereto. It is to be understood that either tongue 132 or 134 may be separately latched to buckle 10 with the remaining tongue subsequently latched thereto as described hereinabove with respect to FIGS. 7–9, or tongues 132 and 134 may alternatively be simultaneously latched to buckle 10 by simultaneously advancing distal portions thereof against concave surfaces 52 and 54 of ejection member 50 such that ejection member 50 is uniformly forced away from latch 36 by overcoming the biasing forces of springs 68 and 70. Under such conditions, the entirety of latch 36 is forced upwardly under the biasing force of springs 32 and 34 such that raised portions 44 and 46 simultaneously enter apertures 138 and 136 of tongues 132 and 134 respectively. In either case, with both tongues 132 and 134 latchingly engaged within buckle 10, latch 36 is operable to force raised portion 44 into aperture 138 of tongue 134, and/or raised portion 46 into aperture 136 of tongue 132, to thereby trap either one, or both, of tongues 132 and 134 between latch 36 and plate 76 (FIG. 1) under the biasing forces of springs 32 and 34.

Referring once more to FIGS. 1 and 3, it can be seen that the flange portion 82 of release member, or post, 80 is positioned to contact the top surface 35 of latch 36 approximately centrally between raised portions 44 and 46. With such a configuration, push button 112 may be pushed toward plate 76 to thereby force post 80 against the top surface 35 of latch 36. Sufficient pressure against push button 112 causes post 80 to uniformly depress latch 36 against springs 32 and 34 due to the central positioning of flange 82 between raised portions 44 and 46. Thus, regardless of whether either one, or both, of tongues 132 and 134 are latchingly engaged within buckle 10, depression of push button 112 sufficiently to overcome the biasing forces of springs 32 and 34 causes the entirety of the top surface 35 of latch 36 to drop below the bottom surfaces 55 of ejection member 50 on either side of recess 58 so that ejection member 50 is urged, under the forces of springs 68 and 70, into engagement with latch 36 as illustrated most clearly in FIGS. 3 and 4. Thus, depression of push button 112 is operable to at least partially eject from buckle 10 any and all tongues latchingly engaged thereto.

It should now be appreciated that the buckle 10 and buckle tongue member 130 of the present invention are configured to permit either individual latching of either tongue 132 or 134 within buckle 10, or simultaneous latching both of tongues 132 and 134 therein. Further, buckle 10 is configured such that latch 36 is responsive to sufficient pressure applied to push button 112 to at least partially eject any and all tongues 132 and/or 134 latchingly engaged within buckle 10. It is to be understood that the position of the various buckle components illustrated in FIGS. 3 and 4 represent a completely unlatched position of latch 36, the position of the various buckle components illustrated in FIGS. 7–9 represent a condition wherein tongue 132 is latchingly engaged with latch 36 via raised portion 46 while raised portion 44 remains in an unlatched position, and that the various buckle components illustrated in FIG. 10 represent a fully latched condition wherein both tongues 132 and 134 are latchingly engaged with latch 36. It is to be further understood that while the present invention has been illustrated and described as being operable to individually or simultaneously latch either one, or both, of a pair of buckle tongues, the present invention contemplates that the concepts described hereinabove may be applicable to buckle and buckle tongue arrangements having more than two buckle tongues associated therewith.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A belt buckle-tongue combination comprising:

a housing having a cavity therein;

a cover mounted to said housing over said cavity;

a single latch member positioned in said cavity and moveable therein;

a plurality of tongue members each receivable within said cavity and latchable to corresponding portions of said single latch member independently of latching of remaining ones of said plurality of tongue members;

a release member extending through said cover and operable to force said single latch member away from said cover to thereby unlatch any of said plurality of tongue members latched to said single latch member; and an ejection member positioned within said cavity and responsive to movement of said single latch member away from said cover to at least partially eject from said cavity each of said tongue members unlatched from said single latch member via said release member.

2. The belt buckle-tongue combination of claim 1 further including a plate mounted to said housing between said housing and said cover, wherein said plate and said housing define said cavity therebetween with said single latch member moveable toward and away from said plate;

and wherein said single latch member and said ejection member are held captive within said cavity by said plate;

and wherein each of said plurality of tongue members are latchable between corresponding portions of said single latch member and said plate.

3. The belt buckle-tongue combination of claim 2 further including means for biasing said single latch member toward said plate.

4. The belt buckle-tongue combination of claim 2 wherein said housing and said plate further define a cavity entrance, and wherein said ejection member is moveable toward and away from said cavity entrance;

and further including means for biasing said ejection member toward said cavity entrance.

5. The belt buckle-tongue combination of claim 4 wherein said means for biasing said ejection member is operable to position a portion of said ejection member between said single latch member and said plate to define a tongue channel therebetween, said tongue channel slidingly receiving a corresponding tongue member therein when said tongue member is not latched between said single latch member and said plate.

6. The belt buckle-tongue combination of claim 5 wherein said tongue member contacts a portion of said ejection member when said tongue member is advanced a first distance into said tongue channel, said tongue member forcing said portion of said ejection member away from said cavity entrance and out of said tongue channel when said tongue member is advanced into said tongue channel beyond said first distance, said means for biasing said single latch member toward said plate forcing said corresponding portion of said single latch member toward said plate to latchingly engage said tongue member therebetween when said tongue member forces said ejection member out of said tongue channel.

7. The belt buckle-tongue combination of claim 6 wherein said portion of said single latch member includes a raised portion and said tongue member includes a bore therethrough, said raised portion of said single latch member received within said bore of said tongue member when said tongue member is latchingly engaged between said single latch member and said plate.

8. The belt buckle tongue combination of claim 2 wherein said release member includes:

a post member having a first end slidably extending through said plate toward said single latch member and an opposite second end; and a release button held captive over said second end of said post member by said cover, said release button biased toward said cover yet moveable away therefrom to force said post member into contact with said single latch member.

9. A belt buckle-tongue combination comprising:

a housing having a cavity therein;

a cover mounted to said housing over said cavity, said cover and said housing defining a cavity entrance therebetween;

a latch member positioned within said cavity;

a single ejection member positioned within said cavity and moveable toward and away from said cavity entrance;

a plurality of tongue members, each of said tongue members separately advanceable within said cavity via said cavity entrance to force a portion of said single ejection member away from said cavity entrance and latchingly engage with said latch member; and operator means for simultaneously unlatching from said latch member any of said tongue members latchingly engaged thereto, said single ejection member responsive to an unlatching of said any of said tongue members from said latch member to move toward said cavity entrance and thereby force said tongue members toward said cavity entrance.

10. The belt buckle-tongue combination of claim 9 further including a plate mounted to said housing between said housing and said cover, wherein said plate and said housing define said cavity therebetween;

and wherein said latch member and said single ejection member are held captive within said cavity by said plate.

11. The belt buckle-tongue combination of claim 10 further including means for biasing said single ejection member away from said cavity entrance.

12. The belt buckle-tongue combination of claim 11 wherein said means for biasing said single ejection member is operable to position said single ejection member between said latch member and said plate to define a tongue channel therebetween, said tongue channel slidingly receiving a corresponding tongue member therein into latching engagement with said latch member.

13. The belt buckle-tongue combination of claim 12 wherein said tongue member contacts said portion of said single ejection member when said tongue member is advanced a first distance into said tongue channel, said tongue member forcing said portion of said single ejection member away from said cavity entrance and out of said tongue channel when said tongue member is advanced into said tongue channel beyond said first distance, said tongue member latching engaging with said latch member when said tongue member forces said portion of said single ejection member out of said tongue channel.

14. The belt buckle-tongue combination of claim 13 wherein said latch member and said plate define first and second tongue channels therebetween;

and wherein said single ejection member defines a first portion thereof in contact with a first tongue member when said first tongue member is advanced said first distance into said first tongue channel, and a second portion thereof in contact with a second tongue member when said second tongue member is advanced said first distance into said second tongue channel.

15. The belt buckle-tongue combination of claim 14 wherein said operator means includes a post extending through said plate into an operable relationship with said latch member;

and wherein said single ejection member defines a concave portion between said first and second portions thereof adjacent to said post, said concave portion rotating about said post when either of said first and second single ejection member portions is forced out of its corresponding tongue channel with the other of said first and second single ejection member portions remaining within its corresponding tongue channel.

16. The belt buckle-tongue combination of claim 15 wherein said concave portion of said single ejection member defines a radius about said post.

17. A belt buckle-tongue combination comprising:

a housing;

a plate mounted to said housing, said plate and housing defining a cavity therebetween;

a plurality of tongue members receivable within said cavity;

latch means for separately engaging with each of said tongue members to thereby retain each of said tongue members within said cavity;

operator means for simultaneously releasing each of said tongue members from said latch means, and ejection means separate from said plurality of tongue members for at least partially ejecting from said cavity each of said tongue members released from said latch means.

18. The belt buckle-tongue combination of claim 17 wherein said latch means includes a single latch member positioned in said cavity and held captive therein by said plate, said single latch member moveable toward and away from said plate;

and further including means for biasing said single latch member toward said plate.

19. The belt buckle-tongue combination of claim 17 wherein said plate and said housing further define a cavity entrance;

and wherein said ejection means includes a single ejection member positioned in said cavity and held captive therein by said plate, said single ejection member moveable toward and away from said cavity entrance;

and further including means for biasing said single ejection member toward said cavity entrance.

20. The belt buckle-tongue combination of claim 17 wherein each of said plurality of tongue members are configured to permit relative movement therebetween toward and away from said cavity.

* * * * *